United States Patent [19]

D'Andrade

[11] 4,245,425

[45] Jan. 20, 1981

[54] TOY HORSE WITH MECHANISM TO PRODUCE TROTTING SOUND

[75] Inventor: Bruce M. D'Andrade, Whitehouse Station, N.J.

[73] Assignee: Arco Industries Ltd., Hong Kong, Hong Kong

[21] Appl. No.: 81,472

[22] Filed: Oct. 3, 1979

[51] Int. Cl.[3] ..... A63H 5/00; A63H 13/02

[52] U.S. Cl. ..... 46/98; 46/105

[58] Field of Search ..... 46/98, 99, 103, 104, 46/105, 106, 107, 111, 112, 114

[56] References Cited

U.S. PATENT DOCUMENTS

| | | | |
|---|---|---|---|
| 233,628 | 10/1880 | Kyser et al. | 46/99 |
| 874,134 | 12/1907 | Stubert | 46/107 |
| 1,829,680 | 10/1931 | Schelle et al. | 46/99 |
| 2,180,623 | 11/1939 | Allen | 46/98 X |
| 2,259,629 | 10/1941 | Fisher | 46/111 |
| 2,266,118 | 12/1941 | Greenman | 46/99 |
| 2,281,757 | 5/1942 | Fisher | 46/99 |
| 2,679,126 | 5/1954 | Doe et al. | 46/114 |
| 2,940,755 | 6/1960 | Pouder | 46/98 X |
| 2,983,072 | 5/1961 | Crawford et al. | 46/98 |
| 3,088,243 | 5/1963 | Giardina | 46/98 X |

FOREIGN PATENT DOCUMENTS

| | | | |
|---|---|---|---|
| 808431 | 7/1951 | Fed. Rep. of Germany | 46/111 |
| 460613 | 8/1938 | United Kingdom | 46/111 |

*Primary Examiner*—F. Barry Shay

*Attorney, Agent, or Firm*—C. Hercus Just

[57] ABSTRACT

A toy horse supported on wheels which reciprocate and oscillate the four legs and bob the pivoted head as the horse is pulled along a surface, the horse also having a hollow body containing a noise-making unit which imitates the clip-clop noise of a trotting horse by means of a sound panel which is hit by two elongated clappers of different lengths operated by a compound type cam entity operated by at least one of the rotating wheels to strike against the sound panel in a pattern to produce such clip-clop noise.

8 Claims, 8 Drawing Figures

TOY HORSE WITH MECHANISM TO PRODUCE TROTTING SOUND

BACKGROUND OF THE INVENTION

This invention pertains to a toy horse supported on wheels for purposes of pulling the horse along a surface to produce a sound which very closely imitates that of a trotting horse, especially a horse trotting on a hard surface.

The manufacture of various kinds of toys supported on wheels and producing either musical or other types of sounds when pulled along a surface has occurred for many years. For example, U.S. Pat. No. 233,628, by Kyser et al, dated Oct. 26, 1880, shows a bell-type musical toy supported by wheels and the arms of the toy strike the bell on the body of the toy. Another sounding toy, including men striking an anvil with hammers, comprises the subject matter of U.S. Pat. No. 874,134 to Stubert, dated Dec. 17, 1907. Several more recent U.S. Pat. Nos. 2,259,629 to Fisher, dated Oct. 21, 1941, and 2,679,126 to Doe et al, dated May 25, 1954, show pull-type toys having rotatable wheels actuating striking members which hit a sounding board.

Still other toys resembling animals supported on rotatable wheels operate the legs and/or pivot the head in somewhat natural movement when pulled along a surface, the legs being operated by cranks on the wheels. Typical of these toys are U.S. Pat. Nos. 1,829,680 to Schelle et al, dated Oct. 27, 1931; 2,180,623 to Allen, dated Nov. 21, 1939; and 2,266,118 to Greenman, dated Dec. 16, 1941.

Another group of patents of interest to the present invention comprise U.S. Pat. No. 2,281,757 to Fisher, dated May 5, 1942 and U.S. Pat. No. 2,940,755 to Pouder, dated June 14, 1960, in which pull-type toys supported on wheels include drop-off type rotatable cams or the like which operate leaf springs to produce a clacking noise. In the Fisher patent, the rotatable front wheel also operates the jaw of the toy duck, while in the Pouder patent, a horse's head is mounted on a stick and the patent states that the toy makes a sound resembling a galloping horse, there being a pair of leaf spring members operated by separate cams rotated by the wheels on the toy.

Lastly, U.S. Pat. No. 2,983,072 to Crawford et al, dated May 9, 1961 and U.S. Pat. No. 3,088,243 to Giardina, dated May 7, 1963 respectively show noise-producing means and, in addition, the Crawford et al patent oscillates the head of the dog-type toy, while the legs of the toy in the Giardina patent are moved to resemble somewhat normal movements, in addition to clicking a leaf spring which is vibrated by an interrupted gear, rotated by the front wheels on the toy.

The principal purpose of the present invention is to provide a pull-type toy appealable to young children and safe to use which resembles a horse and in addition to producing somewhat natural movements of the legs and bobbing the head as the toy is pulled along a supporting surface, a somewhat sophisticated type noise-producing unit simulates a relatively true sound of a trotting horse, especially a horse trotting on a hard surface, such as macadam or cement, details of the same being described hereinafter.

SUMMARY OF THE INVENTION

It is the principal purpose of the present invention to provide a toy horse, including a hollow body having projections adjacent opposite ends of the body and depending downward for purposes of supporting front and rear axles to which wheels having cranks thereon are fixed to opposite ends thereof for purposes of oscillating the lower ends of the four legs on the body of the horse, the upper ends of which are reciprocated vertically, thereby to simulate a somewhat natural movement of the legs of a horse, whereby for toy purposes, at least one of the front wheels also operating link means to oscillate a head on the forward end of the horse in a bobbing manner, while the rear wheels actuate the sound-producing unit of the present invention which represents a marked improvement over known noise-making devices attempting to resemble the sound of a horse trotting on a hard surface, for example, the sound being in synchronism with the movement of the legs on the horse.

Another object of the invention is to include a gear train in the sound-producing unit in the hollow body and rear depending member, the driving gear being rotated by the axle of the rear wheels on the horse and another gear in the train supporting and rotating a rotary-type compound cam arranged to actuate a pair of elongated clappers, the outer ends of which strike a resonating type sound panel in a pattern and sequence which closely resembles the sound of a horse trotting on a hard surface, as aforesaid.

A further object of the invention is to provide a substantially common support for one end of said clappers, while the clappers are of different lengths in order that the upper ends thereof, which have striking heads thereon, produce noticeably different sounds when striking the resonant panel in accordance with the pattern generated by the rotating compound cam entity.

Still another object of the invention is to provide in the compound rotating cam, one drop-off which simultaneously actuates both clappers, while additional individual drop-offs on the cams respectively actuate the clappers in different sequences and, in conjunction with the aforementioned drop-off that commonly moves the clappers, a very audible pattern of sounds is produced in sequence to closely resemble said aforementioned pattern of hoof beats of a horse trotting on a hard surface, while the cranks on the various wheels of the horse oscillate and reciprocate the legs in a pattern of movement corresponding to the sound pattern.

Details of the foregoing objects and of the invention, as well as other objects thereof, are set forth in the following specification and illustrated in the accompanying drawings comprising a part thereof.

DETAILED DESCRIPTION OF THE PREFERRED EMBODIMENT

Figure 1:
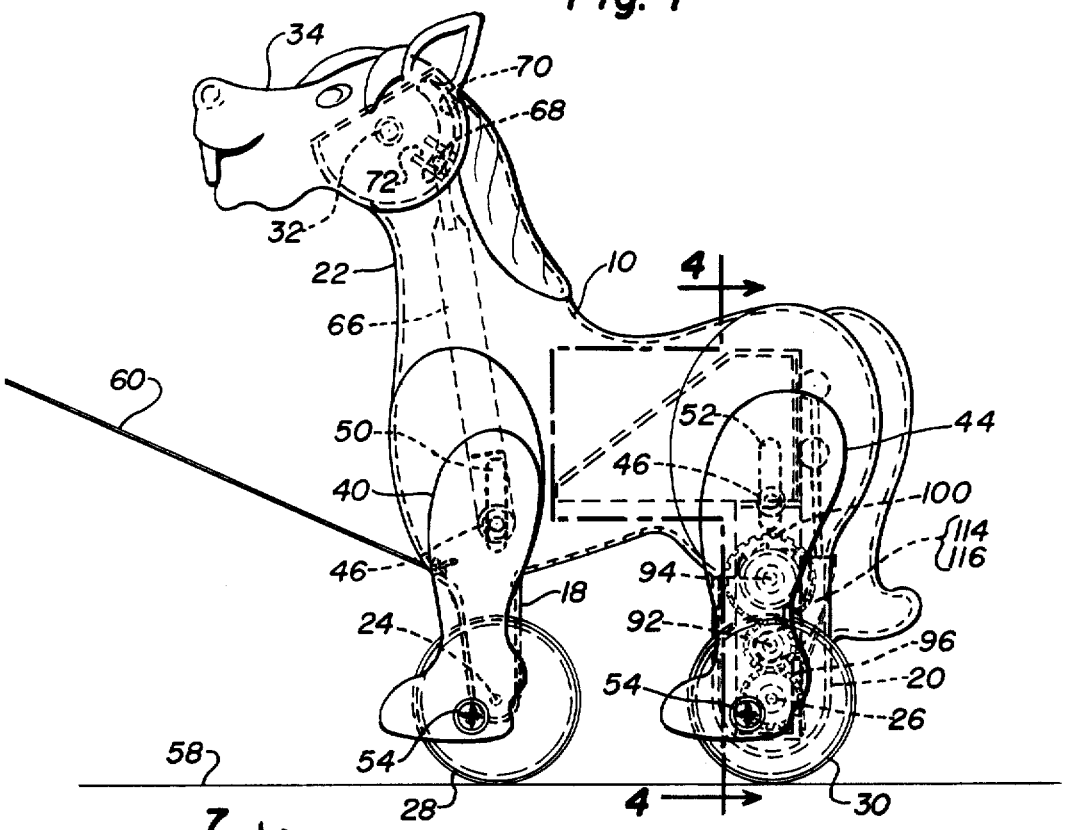
FIG. 1 is a side elevation of a toy horse embodying the principles of the present invention and illustrates the same moving along a horizontal surface.

The horse shown in the various figures comprises a body 10 composed of two similar complementary side members 12 and 14, which are formed by molding from plastic materials and meeting along a central vertical plane 16, the side members being secured along said plane by any suitable means, such as cement or appropriate mechanical means, such as interfitting lugs and sockets of conventional type, not shown. The body 10 also includes a forward depending projection 18, a rearward depending projection 20, and a forward upwardly extending projection 22.

The lower ends of the forward and rearward depending projections 18 and 20 respectively support transverse axles 24 and 26. The opposite ends of forward axle 24 respectively have similar wheels 28 connected thereto and the rearward axle 26 having similar wheels 30 respectively connected to opposite ends thereof. Upward extending projection 22 also has a transverse axle 32 extending therethrough for purposes of supporting one end of a pivoted head 34 which is bipartite and comprising a pair of mating hollow head sections meeting along a central vertical plane 36, along which the mating halves of the head are suitably connected by means similar to those employed to connect the opposite side members 12 and 14 of the body as described above. The lower portion of the head 34 also has an appropriate opening through which the forward upwardly extending projection 22 extends to permit bobbing movement of the head, for example, between the full line and phantom illustration thereof shown in FIG. 7, for example. Oscillation of the head is effected by mechanism described hereinafter.

On opposite sides of the body 10, pairs of front legs 38 and 40 and rear legs 42 and 44 are supported. Said legs are hollow and the inner faces thereof are substantially planar, as is clearly shown in FIGS. 2 and 3. The interiors of said legs have similar bosses 46 molded therein for purposes of supporting headed pins 48 which extend through vertical slots 50 and 52 respectively formed in the forward and rearward depending projections 18 and 20 of the body 10, for purposes of vertically guiding the upper ends of the legs for reciprocatory movement relative to the body 10. Such movement of the legs is effected by crank pins 54 fixed respectively to the wheels 28 and 30 in similarly spaced relationship to the axles 24 and 26, the heads of the pins being received within socket-type bosses 56 molded on the interior of the lowermost portions of the four legs of the horse for purposes of producing rotary gyrations of the lower ends of the legs while simultaneously effecting vertical reciprocation of the upper portions of the legs and thus, simulating somewhat natural movements of the legs of a horse in toy fashion as the horse is drawn along a horizontal surface 58, such as shown in FIG. 1 as it is pulled, for example, by a string 60. To insure rotation of the wheels as pulled along the surface 58, it is preferred that the wheels have friction-type flat bands 62 extending around the circumference thereof as shown in detail in FIGS. 2-4.

Figure 2:
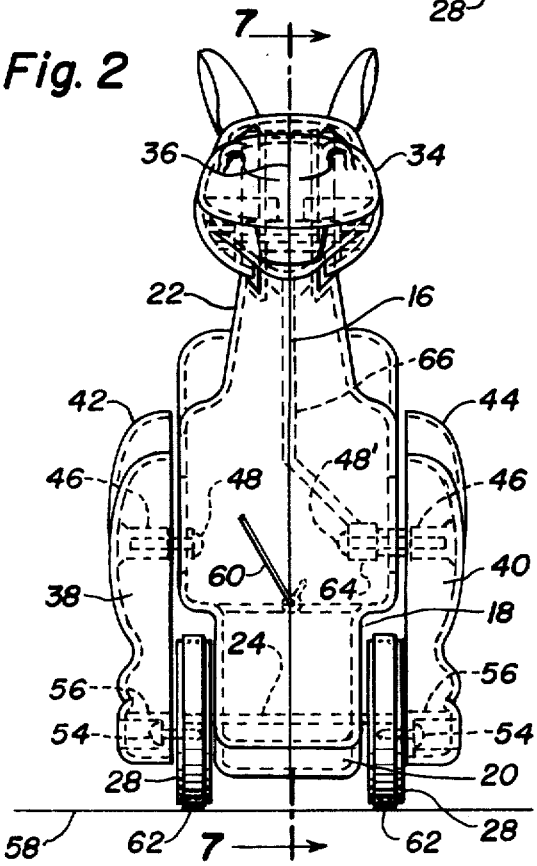
FIG. 2 is a front elevation of the horse shown in FIG. 1.
Figure 3:
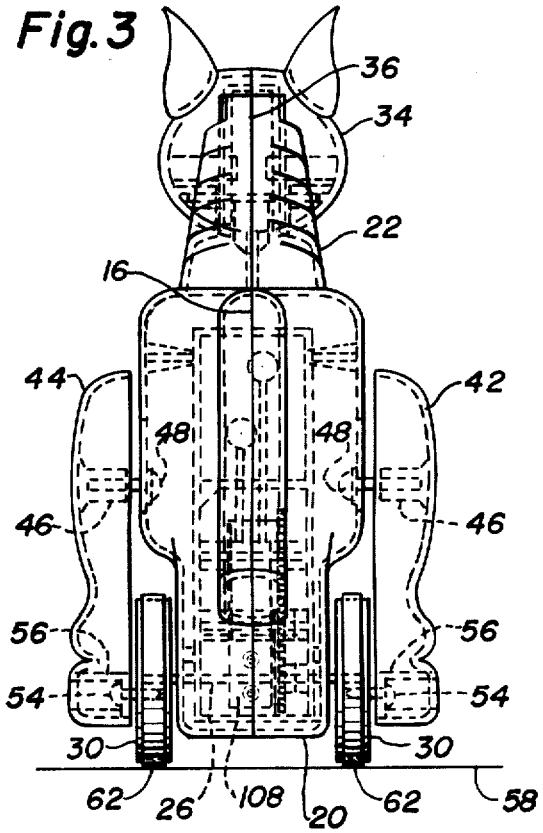
FIG. 3 is a rear elevation of the horse shown in FIG. 1.
Figure 7:
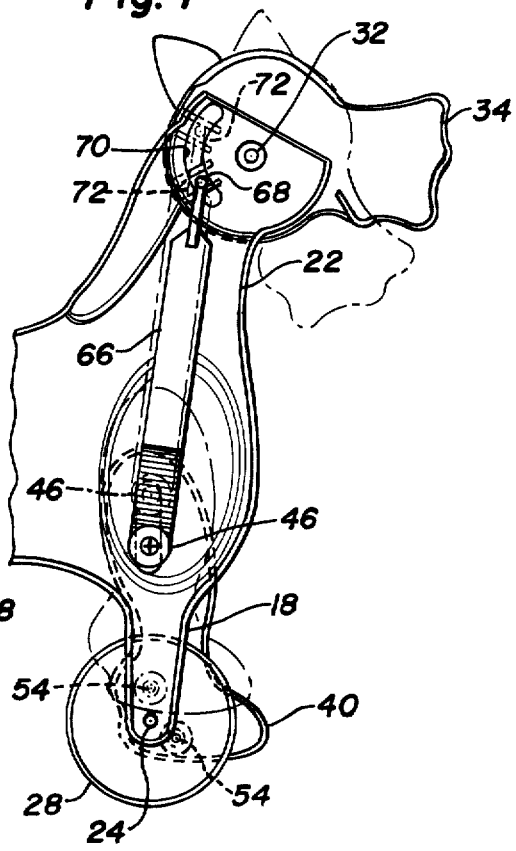
FIG. 7 is a fragmentary vertical sectional view of the forward portion of the horse shown in FIGS. 1 and 2, particularly as seen from the line 7—7 of FIG. 2.

The front wheels 28 not only gyrate the lower ends of the front legs 38 and 40 and vertically reciprocate the upper ends thereof but, in addition, the front leg 40 has a longer pin 48' than the pin 48 in leg 38, for purposes of accommodating the bearing member 64 on the lower end of a link 66, shown in FIGS. 1 and 2, the upper end of said link having a transverse pin 68 fixed thereto and projecting in opposite directions therefrom for reception within an arcuate guide slot 70, best shown in FIG. 7, and comprising the first slot guide means engaged by said transverse pin 68. The interior of the respective halves forming the head 34 have similar pairs of parallel ribs molded therein which define therebetween second or additional guide slots 72 within which the opposite ends of the transverse pins 68 respectively slide for purposes of oscil'ating the head 34 in a bobbing manner as the front wheels 28 rotate.

SOUND-GENERATING UNIT

Figure 4:
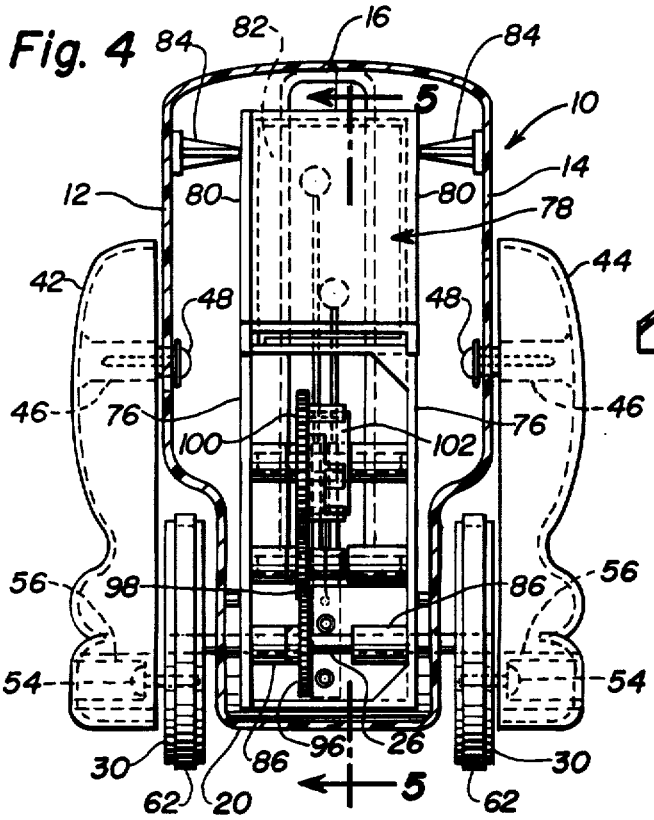
FIG. 4 is a vertical, enlarged sectional view of the rear portion of the horse shown in FIG. 1, as seen on the line 4—4 thereof and showing details of the noise-making unit in vertical elevation.

The rear wheels 30, in addition to oscillating the lower ends of the rear legs 42 and 44 and vertically reciprocating the upper ends thereof, also serve as the power means to actuate the movable members of the sound-generating unit 74, details of which are best shown in FIGS. 1, 4-6, and 8. The rear axle 26 extends between a pair of depending vertical plates 76 which are connected to a somewhat triangular shaped head 78, comprising opposite parallel side members 80, having a rearward ends between which a substantially vertical resonant-type sound panel 82 is fixedly mounted. The panel 82 preferably comprises a sheet of suitable rigid plastic material. The opposite sides of the head 78 are engaged by transverse positioning members 84, respectively projecting from the inner surfaces of the opposite side members 12 and 14 of the body 10, as shown in FIG. 4, and the lower ends of the vertical plates 76 have bearings 86 therein through which the rear axle 28 extends for further supporting the unit 74 within the rear portion of the body 10 and the interior of the rearward depending projection 20 which, as will be seen from FIG. 1 in particular, is substantially wider than the forward depending projection 18 and has ample space to accommodate the gear train, details of which are as follows:

The opposite vertical plates 76 respectively have similar additional bearings 88 and 90 projecting inwardly toward each other from the inner surfaces of the vertical plates for respectively supporting the opposite ends of intermediate shaft 92 and upper shaft 94. Drive gear 96 is fixed to the rear axle 26 for rotation of the gear as the rear wheels 30 rotate. An intermediate idler pinion 98 is rotatably supported on intermediate shaft 92 and said idler pinion 98, in turn, engages the relatively large diameter driven gear 100 that is supported upon upper shaft 94 and is fixed to the compound cam 102 to drive the same in the direction of the arrow shown in FIG. 5, when the horse is moved forwardly to rotate the drive gear 96 in the direction of the arrow shown thereon in FIG. 5.

Figure 5:
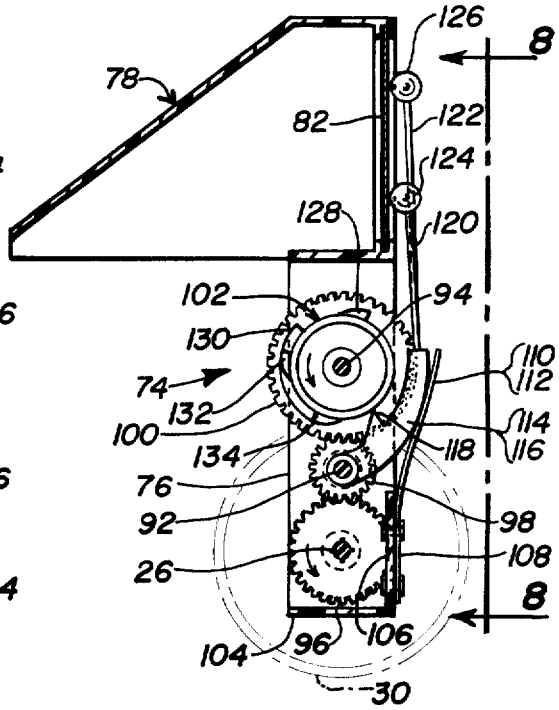
FIG. 5 is a vertical sectional view of the noise-making unit per se shown in FIG. 4, as seen on the line 5—5 thereof.
Figure 8:
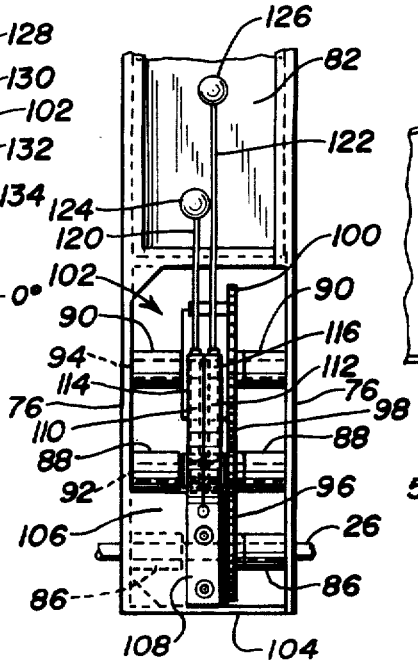
FIG. 8 is a fragmentary vertical elevation of the soundmaking unit shown in FIG. 5, as seen on the line 8—8 thereof.

The lower ends of the vertical plates 76 are connected by a transverse bottom plate 104 which is formed of the same material as the vertical plates 76 and the members of the head 78. As shown in FIG. 5, these members are illustrated as being formed from plastic material for purposes of minimizing the cost of producing the same. Also, extending upward from bottom plate 104 and connected to the left-hand vertical plate 76, as viewed in FIG. 8, is a short vertical supporting plate 106, as shown in FIGS. 5 and 8. The plate 106 supports the lower end of a leaf spring 108, the upper end of which is longitudinally split to form a pair of spring fingers 110 and 112, for purposes described below.

The intermediate shaft 92 supports suitable bearings formed on the lower ends of a pair of arcuate supports 114 and 116 which are similar and each of the same have a pointed cam follower projection 118. Referring to FIG. 8, it will be seen that the support 114 has a shorter spring wire clapper 120 projecting upwardly therefrom, the same being parallel to a longer spring wire clapper 122, which projects upward from arcuate support 116. Clapper 120 terminates in a spherical head 124 and the longer clapper 122 terminates in a spherical head 126.

Figure 6:
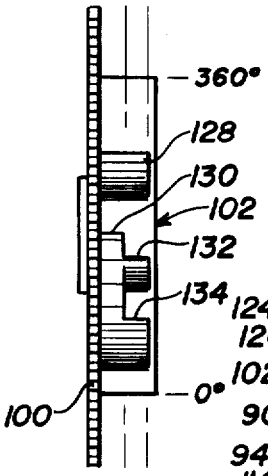
FIG. 6 is a planar evolution of the cam member of the noise-making unit shown in FIGS. 4 and 5 for purposes of illustrating the disposition of the various drop-off elements of said cam.

From FIGS. 5 and 8, it will be seen that the heads 124 and 126 respectively on the short and long wire clappers 120 and 122 engage the resonant sound panel 82 at different locations and respectively produce different audible sounds when the panel 82 is struck thereby individually and a still different tone or sound is produced when the heads strike the panel 82 simultaneously, thereby producing a variety of sounds which, when occurring in certain sequences, as described below, resemble the clip-clop of a horse when trotting upon a hard surface, such as a city street or asphalt road, the desired sequence of sounds being generated by operation of the compound cam 102, the nature and operation of which is as follows:

Attention is directed to FIGS. 5 and 6 wherein the location of cam drop-offs are best illustrated. The circumferential disposition of the drop-offs is illustrated in end view of the cam in FIG. 5, while FIG. 6 presents a planar evolution of the cam member with respect to the gear member 100. A common drop-off 128 engages the cam follower projections 118 simultaneously, whereby the heads 124 and 126 contact the sound panel 92 simultaneously to produce one type of sound or tone. Drop-off 130 is spaced counterclockwise from drop-off 128 as shown in FIG. 5 and is engaged only by the follower projection 118 of support 116 of the long clapper 122. A pair of drop-offs 132 and 134 are successively engaged by the follower projection 118 of the support 114 for short clapper 120 and produce a still different sound in succession, particularly comprising the "clip" sound of the compound clip-clop overall sound generated by the full operation of the cam 102 and the long and short clappers 122 and 124. From FIG. 5, it will be seen that the spring fingers 110 and 112 maintain the follower projections 118 constantly in sliding engagement with the cylindrical dwell portions of the cam 102, as well as along the ascending portions of the cam preceding the drop-offs. Normally, the heads 124 and 126 of the clappers are slightly out of contact with the sound panel 82 but, when the drop-off of the follower projections 118 occurs, the motion is sudden and this causes the resilient spring wires of the clappers 120 and 122 to flex sufficiently to cause the heads 124 and 126 to momentarily contact the sound panel 82 somewhat in the nature of the heads of drum sticks contacting a drumhead.

From the foregoing, it will be seen that the present invention provides a harmless but entertaining toy for small children in which the four legs of the simulated horse oscillate at the lower ends and vertically reciprocate at the upper ends to simulate actual leg movements, while the head of the horse bobs in natural fashion and, simultaneously, the sound-generating unit 74 produces the desired clip-clop sound of a trotting horse, which is quite unlike the clacking sound produced by a leaf spring being flexed and then released by a rotating cam drop-off for engagement of the spring end with the cam periphery adjacent the drop-off as is common in many of the sound-producing toys of the patents cited hereinabove. As a further characteristic of the invention, the sound pattern is related to the movement of the legs of the toy horse, and thereby further simulating a natural sound with visual movement of the legs of the toy horse.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A toy horse comprising a hollow rigid body enclosing sound mechanism imitating the clip-clop of a horse trotting along a hard surface, fore and aft projections depending respectively from the forward and rearward ends of said body rotatably supporting transverse axles, wheels mounted on opposite ends of said axles, front and rear legs mounted on opposite sides of said body, means on said horse supporting the upper ends of said legs for vertical movement and crank pins on said wheels engaging the lower ends of said legs and operable to gyrate the lower ends of said legs in sequence with each other while vertically moving the upper ends thereof, whereby as said body is pulled along a horizontal surface said leg movements simulate the trot of a horse, in combination with a sound-generating unit inside said body and one said depending projection thereon, said unit comprising a gear train including one gear fixed to the axle supported by said one projection for rotation thereby when the horse is pulled as aforesaid and another gear connected to compound cam means rotatable about a horizontal axis and including circumferentially and axially spaced cam drop-offs, a rigid sounding panel fixed to said unit, and a pair of elongated clappers of different lengths connected at one end to a support portion of said unit and engageable intermediately of the ends thereof by said cam means to produce an intermittent pattern of engagements of said sounding panel by said pair of clappers to produce different tones resembling the clip-clop of a horse.

2. The toy horse according to claim 1 further characterized by the clappers of said sound-generating unit being pivotally supported at said one end and spring means engaging said clappers intermediately of the ends thereof and urging them toward said cam means.

3. The toy horse according to claim 1 further characterized by said sounding panel being generally parallel to said clappers when struck thereby and the different lengths of said clappers striking said sounding panel at different longitudinal distances from said one end of said clappers, thereby producing different tones respectively by said clappers.

4. The toy horse according to claim 3 further characterized by said compound cam means comprising a plurality of cam drop-offs spaced axially relative to the axis of the gear which rotates it and said clappers being side-by-side within a plane parallel to said axis of said rotatable cam means, certain of said cam drop-offs actuating said shorter clapper sequentially but out of sequence with other drop-offs which actuate said longer clapper and still another drop-off extending axially across the cam means and operable commonly to effect simultaneous actuation of both clappers to produce a further different tone.

5. The toy horse according to claim 1 in which said sound-generating unit is at least partially in the aft depending projection and the axle thereon which operates said cam means also operates the rear legs of said horse as aforesaid.

6. The toy horse according to claim 5 in which the body of said horse further supports a head pivotally at the forward end thereof and the axle on the forward depending projection is interconnected to said head and is operable to oscillate the same in a bobbing manner.

7. The toy horse according to claim 6 further including link means pivotally connected at one end to at least one front leg and the opposite end being connected to said head in spaced relationship to the pivot thereof, whereby as said front leg is reciprocated vertically at the upper end by rotation of the crank means of the wheels on the forward axle said head will be oscillated as aforesaid.

8. The toy horse according to claim 7 further including an upwardly extending projection on the forward end of the body of said horse and having a pivot supporting said head and a first guide slot slidably receiving the end of said link means which is connected to said head, and a second guide slot on said head substantially transverse to said first guide slot and slidably receiving a projection on said end of said link to comprise the connection thereof to said head and said first guide slot controlling the movement of said projection on said link relative to said second slot.

* * * * *